US007679568B2

(12) United States Patent
Nilsson et al.

(10) Patent No.: US 7,679,568 B2
(45) Date of Patent: Mar. 16, 2010

(54) FEEDING CLIP

(75) Inventors: Jonas Nilsson, Allmogevägen (SE); Jonas Starck, Akersberga (SE)

(73) Assignee: Laird Technologies AB, Kista (SE)

( * ) Notice: Subject to any disclaimer, the term of this patent is extended or adjusted under 35 U.S.C. 154(b) by 906 days.

(21) Appl. No.: 11/425,619

(22) Filed: Jun. 21, 2006

(65) Prior Publication Data

US 2006/0290591 A1 Dec. 28, 2006

(51) Int. Cl.
*H01Q 1/24* (2006.01)
*H01Q 1/50* (2006.01)

(52) U.S. Cl. ..... 343/702; 343/906; 439/846; 439/862

(58) Field of Classification Search ..... 343/700 MS, 343/702, 846, 906; 439/843, 846, 862, 916
See application file for complete search history.

(56) References Cited

U.S. PATENT DOCUMENTS

| | | | | |
|---|---|---|---|---|
| 4,925,400 | A | 5/1990 | Blair et al. | |
| 6,512,491 | B2 | 1/2003 | Kanayama et al. | |
| 7,095,375 | B2 * | 8/2006 | Kfoury et al. | 343/702 |
| 7,224,312 | B2 * | 5/2007 | Wen et al. | 343/700 MS |
| 2002/0126050 | A1 | 9/2002 | Oshiyama et al. | |
| 2003/0142022 | A1 * | 7/2003 | Ollikainen et al. | 343/702 |
| 2004/0051673 | A1 | 3/2004 | Moren et al. | |

FOREIGN PATENT DOCUMENTS

| | | |
|---|---|---|
| JP | 08-274526 | 10/1996 |
| JP | 2000-114833 | 4/2000 |
| JP | 2002-246935 | 8/2002 |
| KR | 1020030056488 | 7/2003 |
| WO | WO02080304 | * 10/2002 |

OTHER PUBLICATIONS

Office Action with translation issued on Nov. 27, 2007.

* cited by examiner

*Primary Examiner*—Michael C Wimer
(74) *Attorney, Agent, or Firm*—Harness, Dickey & Pierce, P.L.C.

(57) ABSTRACT

The present invention relates to an antenna assembly comprising a support structure for carrying a radiating structure and at least one feeding clip, the antenna assembly is provided to be mounted on a PCB in a mobile communication device, the support structure comprises a top side part which is to be mounted substantially parallel with the PCB, the top side part is positioned, when mounted on the PCB, at a first distance from the PCB, and the radiating structure comprises at least one contact area located on the support structure. The antenna assembly is characterised in that the contact area for the radiating structure is located at a position on the support structure where a distance between the contact area and the PCB is less than the distance between said top side part and the PCB. The invention also relates to a feeding clip.

20 Claims, 5 Drawing Sheets

FEEDING CLIP

TECHNICAL FIELD

The present invention relates to an antenna assembly and a feeding clip. More specifically the present invention relates to an antenna assembly and a feeding clip for effective electrical coupling of RF signals between circuitry in a mobile communication device and the antenna assembly as well as effective use of available space.

BACKGROUND OF THE INVENTION

As portable radio communication devices, such as mobile phones, become smaller the electronic components contained within the devices, e.g. antennas, will also need to be smaller. The electrical connection of these components is realized by means of connectors, which shall provide good and well defined electrical contact and which should be insensitive to small variations in manufacturing dimensions.

Therefore, elastic type or spring type of connector is becoming increasingly attractive for small components. Such connectors are known to provide reliable electrical connection. Spring features provide a well-defined contact and the flexibility to avoid tolerances build up when manufacturing dimensions are not all perfectly exact. The compliance is also needed to accommodate departures from planarity as is common in high volume manufacturing processes where the contact pads may not be exactly flat.

The conventional method of electrically connecting such an electronic component, being of a miniature size, is to interpose between the electronic component and the printed circuit board, an electrical connector such as a so-called pogo pin connector.

The pogo pin is an elongated pin containing a head that makes contact with one surface and can be compressed by its connection to a spring within a socket of the pin that is soldered to the printed circuit board.

Mobile phones are also subject to cost reduction demands as well as increasing adaptation for large-scale manufacturing. For that reason parts included in a mobile phone are preferably designed to ensure low manufacturing and assembling costs. The above mentioned pogo pins are rather complicated, including a plurality of details, and their sockets may have to be soldered to a component in the communications device. Thus, the use of pogo pins is relatively expensive.

Another problem with prior art connectors using a helical spring or the like is that the electrical parameters, notably inductance and capacitance, vary with the length of the spring. Thus, in some applications in which the spring is compressed, this compression creates unwanted variations in the RF characteristics. Furthermore, the use of a helical spring sets a lower limit on the length of the connector device.

Another drawback with some prior art solutions is that the connector device occupies space that otherwise could be used as an effective radiating area of a radiating element.

SUMMARY OF THE INVENTION

It is a main object of the present invention to provide such apparatus and method that at least alleviate the above problems.

It is in this respect a particular object of the invention to provide such antenna assembly and feeding clip that provides a shorter electrical pathway between a feeding point on a printed circuit board (PCB) of a mobile communication device, on which the antenna assembly is to be mounted, and a grounding point on the PCB through a radiating structure of the antenna assembly.

It is still a further object of the invention to provide such antenna assembly and feeding clip that enables coupling to contact areas on a PCB, for electrical coupling to circuitry or ground, that are located at the periphery of the PCB.

It is still a further object of the present invention to provide such antenna assembly and feeding clip that leaves more space for radiating structures on the antenna assembly.

It is still a further object of the present invention to provide such antenna assembly and feeding clip that exhibit excellent electrical characteristics while still possessing strong mechanical characteristics and being suitable for assembly processes.

These objects among others are, according to a first aspect of the present invention, attained by an antenna assembly comprising a support structure, a radiating structure and at least one feeding clip, the antenna assembly is provided to be mounted on a PCB in a mobile communication device. The support structure comprises a top side part and surrounding side parts forming a box-like structure to be mounted on the PCB with the top side part away from the surface of the PCB.

The above describes a common design in internal antenna assemblies used in mobile communication devices, such as cellular phones. The support structure is provided to give a defined mounting area for the radiating structure, a rigid antenna assembly device which is easy to handle in a manufacturing process and to define a distance between the radiating element and the PCB, printed circuit board, for achieving specified RF characteristics. The antenna type is typically a planar inverted F-antenna even though other antenna types and many different antenna designs are contemplated and the present invention is not limited to any particular type. The support structure is preferably moulded.

The radiating structure may typically be a printed conductive pattern on a flexible dielectric substrate having an adhesive on a backside for mounting on the support structure. This design provides many advantages including being able to fold parts of the radiating structure onto the side portions of the support structure to thereby further control the RF characteristics of the antenna. However, other radiating structures are contemplated such as coating or painting the support structure with a conductive paint, or using a bent conductive plate mounted on the support structure. The invention is thus not limited to the selection of radiating structure, other than what is defined below.

The radiating structure comprises at least one contact area folded over an edge of the top side part onto a surrounding side part. The feeding clip is mounted on one of the surrounding side parts and comprises a first spring loaded portion exerting a contact force against the contact area for achieving electrical contact between the radiating structure and the feeding clip.

The feeding clip is thus mounted on a side portion of the support structure and is coupled to the radiating structure by a spring loaded portion exerting a contact force against a contact area located on the side portion of the support structure. Since the contact area is located on a side portion of the support structure, there is no need to provide a contact area on top of the antenna assembly which would otherwise steal valuable space from the radiating structure. Thus, by the provisions according to the present invention more space is available for the radiating structure design compared to conventional antenna assemblies.

Further more, since the contact area is positioned a bit down at a side portion of the support structure and not a bit in on the top side, the pathway for the RF-signals in the feeding clip is reduced. More specifically the pathway from a feeding point to a grounding point is shorter compared with conventional feeding clips. The feeding point is located on the PCB for feeding RF-signals to the radiating structure and the grounding point is located on the PCB proximate to the feeding point for providing a grounding point for the radiating structure.

This is very beneficial since the electrical characteristics for the radiating structure is relatively easy to control in the manufacturing process, whereas the electrical characteristics of the feeding clip is not. A PIFA antenna is fed by a feeding clip, connected between the PCB and the radiating structure. There is also a grounding clip, connected between the PCB ground and the radiating structure. The electrical length from the feed point via two clips, and a part of the radiating structure, is essential for the matching of the PIFA antenna. While using short clips, another degree of freedom is introduced to adjust the matching for a PIFA antenna.

The feeding clip further comprises a second spring loaded portion extending out and away from the surrounding side portion and exerting a contact force against a contact area on the PCB for achieving electrical contact between the radiating structure and the feeding clip when the antenna assembly is mounted on the PCB.

The feeding clip is thus provided with at least two spring loaded portions where the second is provided for coupling the feeding clip, and thereby the radiating structure, to circuitry in a mobile communication device. The second spring loaded portion is extending out from the support structure so that the contact point, as defined by a contact portion of the spring loaded portion, is located at the periphery of the support structure or even a short distance away from the support structure.

Conventionally, the connection portion from the feeding clip has been directed in a substantially vertical direction, that is straight down from a position on the support structure located a bit from a side edge, in the case of so called pogo pins, or possibly directed inwards, towards the centre of the support structure, when a conventional clip, which is mounted with spring action between a top part and a lower support part of the support structure, is used.

Since the feeding clip, according to the present invention, is provided with a coupling portion, for coupling to the PCB, which is directed out and away from the support structure it is possible to contact circuitry or the ground plane on the PCB very close to the periphery.

This is beneficial since the PIFA antenna take advantage of the ground plane as a part of the antenna. The length of the ground plane is important for the resonant structure of the PIFA. The grounding connection from the PIFA to the PCB is a critical connection, which decides the effective length of the PCB, which will be used by the PIFA antenna. If the PCB is short, it is an advantage to position the grounding connection as far out on the PCB periphery as possible.

According to one aspect of the present invention the radiating structure is mounted at least partly on the top side part of the support structure and according to another variant of the invention the radiating structure is mounted at least partly on a side part of the support structure.

According to one aspect of the present invention the surrounding side parts have a first defined height for distancing the radiating structure from the PCB, and the feeding clip is a fraction in size of the first defined height so that the first spring loaded portion exert the force against the surrounding side portion a distance from the top side part.

According to one aspect of the present invention the feeding clip comprises a first rectangular area, a second rectangular area orthogonally provided on one longer side of the first area, and a third rectangular area provided parallel and opposite with respect to the second area so that the first, second and third areas form a U-shaped beam where the first area is the bottom of the beam.

By shaping the main structural part of the feeding clip in a U-shaped form, structural rigidity is achieved as well as the possibility to use thinner plate. This provides for a more easy manufacturing process and provides means for mounting the feeding clip at the side of the support structure in an efficient manner, amongst other things.

According to one aspect of the present invention a first and second cut is provided in a first short side of the first area, and the portion between the first and second cut is bent away from the second and third areas of the U-beam to define the first spring loaded portion. The second spring loaded portion is extending from the middle of second shorter side of the first area and is bent in the opposite direction of the first spring loaded portion. The spring loaded portions are thus integrated into the U-beam form.

According to one aspect of the present invention the second and third areas are provided with an upside-down L-formed cut extending from a free long side and a portion of the second and third sides, defined by the cut, is bent out and away from the side to form a locking mechanism for locking the feeding clip in position in the support structure.

According to one variant of the present invention the top side part of the support structure is located at a first distance from the PCB, and the feeding clip has a height that is smaller than the distance between the top side part and the PCB.

According to one variant of the present invention the PCB constitutes a ground plane for the antenna assembly.

According to one aspect of the present invention the support structure comprises at least one receiving member for receiving the feeding clip in a press-fit coupling on the surrounding side part.

According to one aspect of the present invention the feeding clip is made of a copper alloy, such as $CuSn_6$. Conventionally, feeding clips are made of stainless steel, which exhibits good characteristics from a mechanical and manufacturing perspective, but are inferior with regards to electrical characteristics compared to for instance a copper alloy. The design according to the present invention has surprisingly shown mechanical characteristics, even with the selection of a copper alloy as material for the feeding clip, fulfilling the mechanical and manufacturing requirements posed. This is surprising since the feeding clip has very small dimensions which normally would require a harder material.

According to one aspect of the present invention the spring loaded action for the first and second spring loaded portions is created by use of the elastic properties of the feeding clip material.

According to one aspect of the invention the antenna assembly is a PIFA, Planar Inverted F-antenna.

The above objects among others are, according to a second aspect of the present invention, attained by a feeding clip for mounting on an antenna support structure to connect circuitry located in a mobile communication device to a radiating structure located on the support structure.

The feeding clip comprises a first rectangular area, a second rectangular area orthogonally provided on one longer side of the first area, and a third rectangular area provided parallel and opposite with respect to the second area so that the first, second and third areas form a U-shaped beam where the first area is the bottom of the beam.

A first and second cut is provided in a first short side of the first area, and the portion between the first and second cut is bent away from the second and third areas of the U-beam to define the first spring loaded portion, a second spring loaded portion is extending from the middle of second shorter side of the first area and is bent in the opposite direction of the first spring loaded portion.

The above objects among others are, according to a third aspect of the present invention, attained by an antenna assembly comprising a support structure for carrying a radiating structure and at least one feeding clip, the antenna assembly is provided to be mounted on a PCB in a mobile communication device, the support structure comprises a top side part which is to be mounted substantially parallel with the PCB, the top side part is positioned, when mounted on the PCB, at a first distance from the PCB, and the radiating structure comprises at least one contact area located on the support structure.

The antenna assembly is characterised in that the contact area for the radiating structure is located at a position on the support structure where a distance between the contact area and the PCB is less than the distance between said top side part and the PCB.

By providing to contact area closer to the ground plane, and providing a feeding clip that is correspondingly shorter in height for connecting the radiating structure to circuitry located on the PCB, the pathway for the RF-signals in the feeding clip is reduced. More specifically is the pathway from a feeding point, located on the PCB for feeding RF-signals to the radiating structure, to a grounding point, located on the PCB proximate to the feeding point for providing a grounding point for the radiating structure, shorter compared with conventional feeding clips.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1 to 5, which are given by way of illustration only, and thus are not limitative of the present invention.

PREFERRED EMBODIMENTS

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

Figure 2:
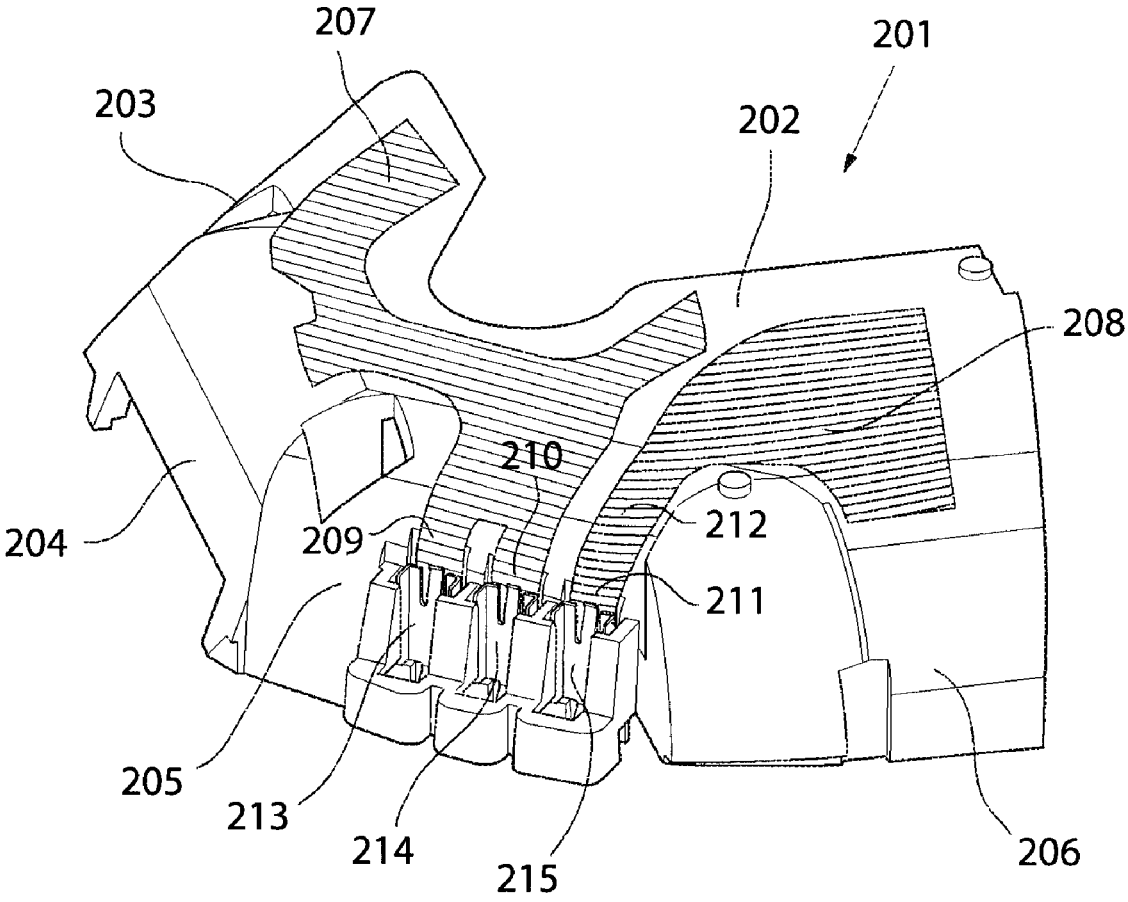
FIG. 2 is a schematic perspective view of an antenna assembly according to one aspect of the present invention.
Figure 3A:
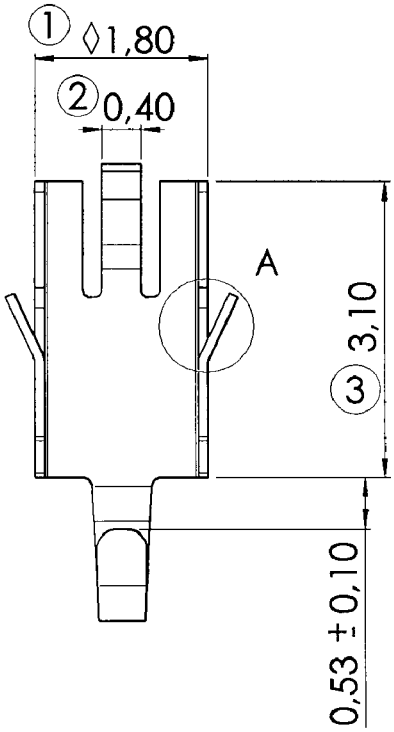
FIG. 3*a* is a front side view of the feeding clip according to one variant of the invention.
Figure 3C:
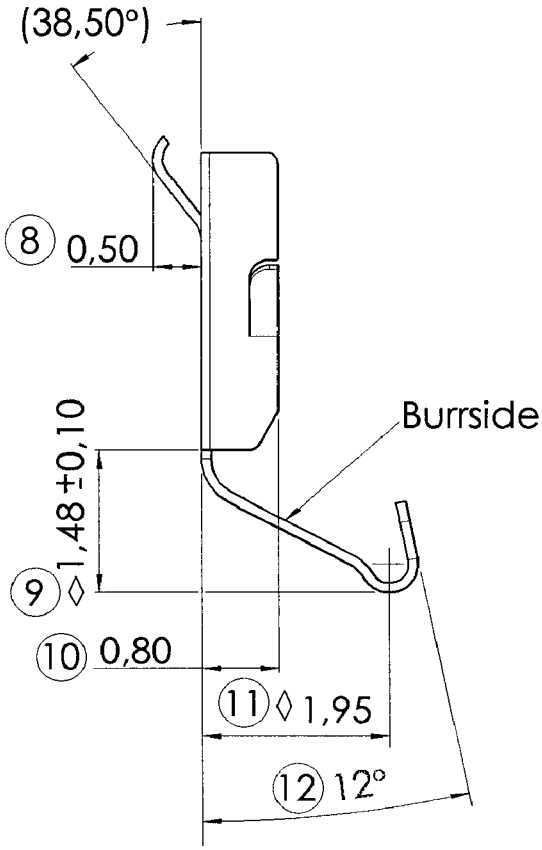
FIG. 3*c* is a side view of the feeding clip according to one variant of the invention.
Figure 3B:
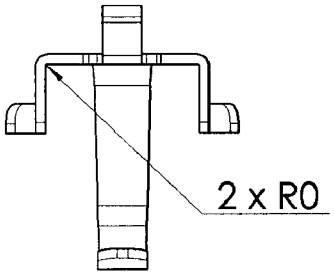
FIG. 3*b* is a top side view of the feeding clip according to one variant of the invention.
Figure 3D:
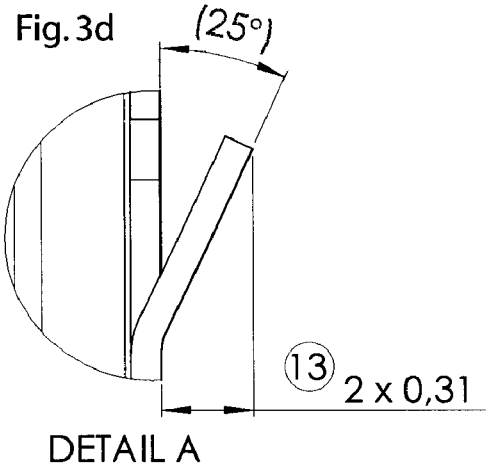
FIG. 3*d* is a detail side view of the part A in FIG. 3*a*.
Figure 3E:
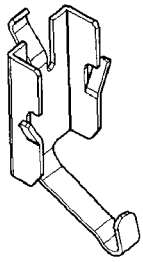
FIG. 3*e* is a perspective view of the feeding clip according to one variant of the invention.

FIG. 2 is a schematic view in perspective of an antenna assembly according to on aspect of the present invention. A support structure 201 is moulded into a predetermined shape to fit in a mobile communication device (not shown). The support structure 201 is to be mounted on a PCB, printed circuit board (not shown), of the mobile communication device. The support structure 201 comprises a top part side 202 and several surrounding side parts 203, 204, 205 and 206, so that the support structure 201 takes a box-like shape, as is shown in FIG. 2.

A first radiating structure 207 and a second radiating structure 208 are mounted on the top side part. As is shown in FIG. 2 the first radiating structure 207 comprises first and second portions folded down onto the surrounding side portion 205 to constitute a first and second contact area 209 and 210, respectively. The second radiating structure 208 comprises a third portion 212 folded down on the surrounding side portion 205 constituting a third contact area 211.

First, second and third feeding clips 213, 214 and 215, respectively are mounted in respective receiving members on the side portion 205. The receiving members are preferably moulded together with the support structure.

Figure 1:
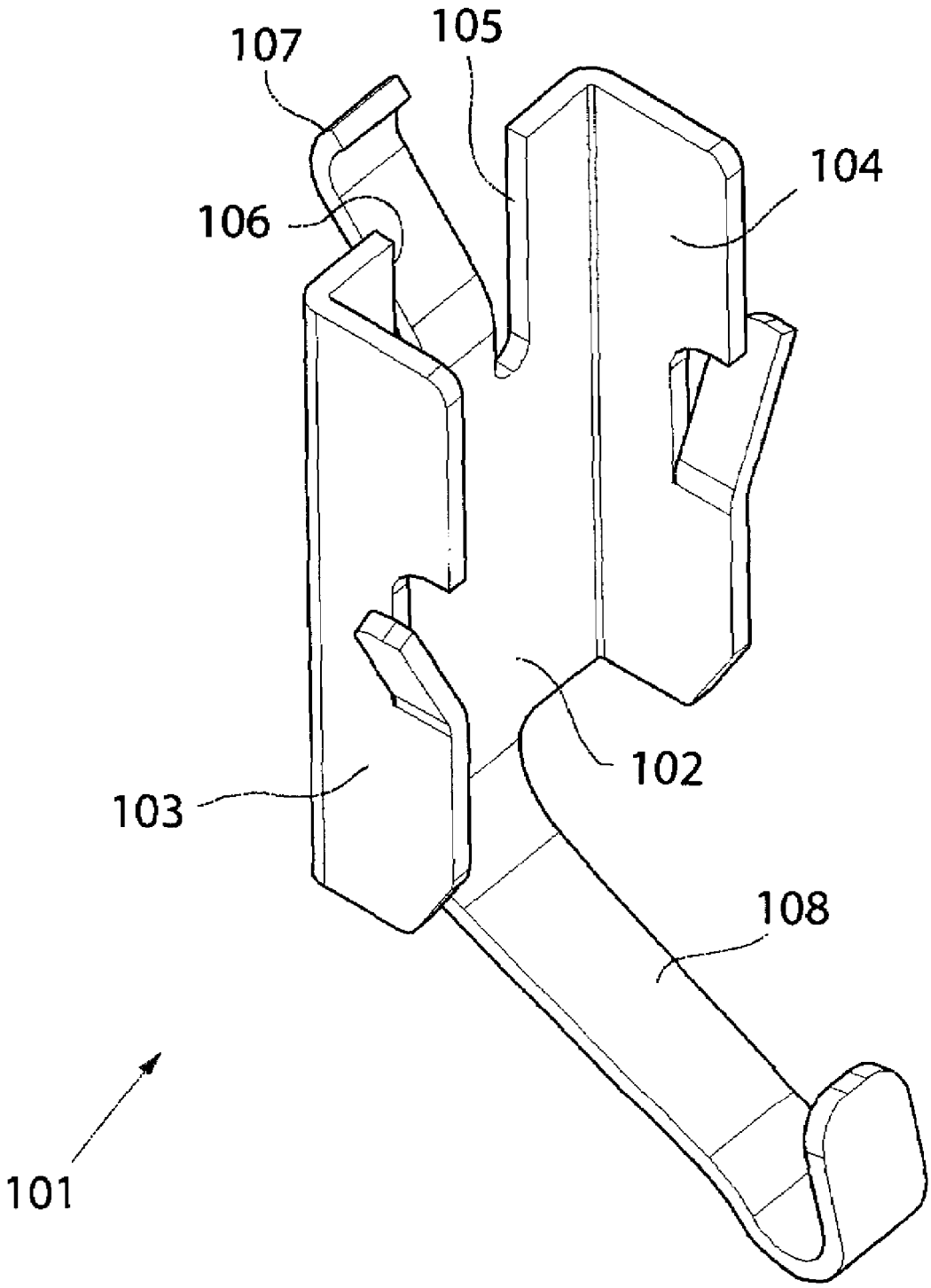
FIG. 1 is a schematic perspective view of a feeding clip according to one aspect of the present invention.

FIG. 1 is a schematic perspective view of one of the feeding clips in FIG. 2 according to one aspect of the invention. The feeding clip 101 comprises a first rectangular portion 102, a second rectangular portion 103 which is orthogonal in relation to the first rectangular portion 102 and a third rectangular portion 104 which is parallel with the second rectangular portion 103. The three rectangular portions thus construe a U-shaped beam form of the main part of the feeding clip 101, as is apparent from FIG. 1, which brings stability and rigidity to the feeding clip design.

A first and a second cut 105 and 106 are provided in the first portion 102 and the part between the cuts are bent out and away from second and third portions 103 and 104, to construe a first spring loaded portion 107. The first spring loaded portion 107 is designed to electrically couple the feeding clip to the contact areas defined by to portions of the radiating structures being folded down on a surrounding side portion of the support structure as is disclosed in FIG. 2.

A second spring loaded portion 108 extends from a short side of the first rectangular portion 102 in an opposite direction in relation to the first spring loaded portion 107. The second spring loaded portion is provided to electrically couple the feeding clip to circuitry in the mobile communication device. As is seen in combination with FIG. 2 the second spring loaded portion extends in a direction out from the support structure 201 and will thus provide a contact point with a PCB which is located on the rim of said support structure or even a bit out from it.

FIGS. 3*a* to 3*e* show the feeding clip in different views with distance and angle measures of different parts of the feeding clip noted. All distances are measured in millimeters and angles in degrees. As is obvious the feeding clip is very small, with a main body measuring only 3.1 millimeters in height and 1.8 millimeters in width.

Figure 4:
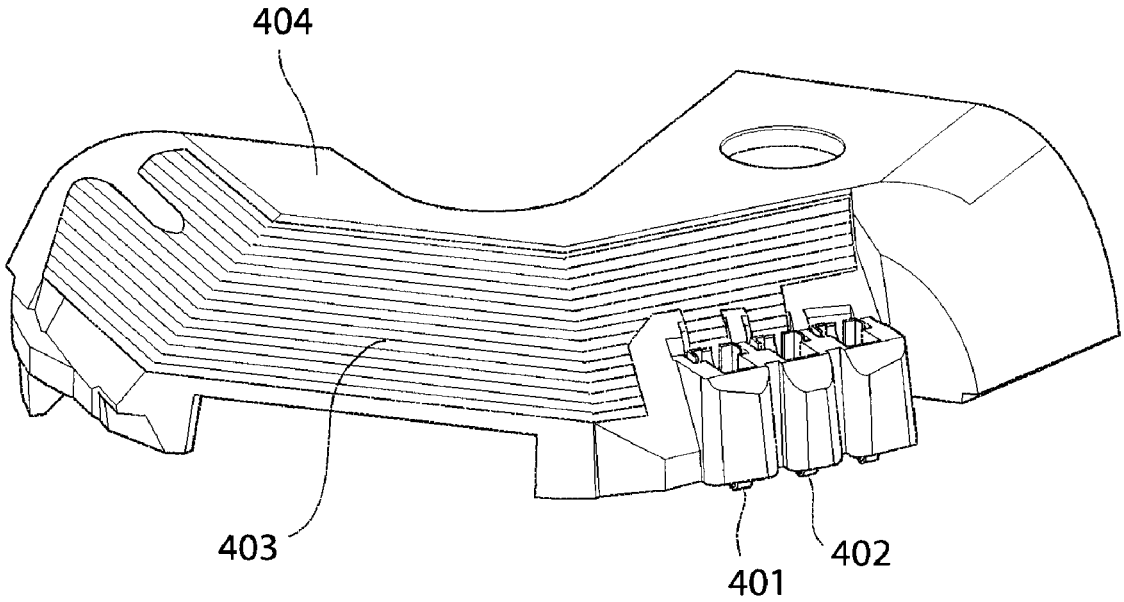
FIG. 4 is a perspective view of an antenna assembly according to one aspect of the invention where a radiating structure is located at a side portion of a support structure.

FIG. 4 is a perspective view of the antenna assembly according to one variant of the invention. A first and a second feeding clip, 401 and 402, are provided for connecting a radiating structure 403 to circuitry (not shown) located on a PCB (not shown). The first feeding clip is connected to a feed and the second feeding clip is connected to ground. As is easily visible in the figure the radiating structure 403 is not provided on the top side of a support structure 404 but rather on a side part. This is achievable since the connection between the radiating structure and the feeding clip also is provided at the side part according to what has been previously described above.

Figure 5:
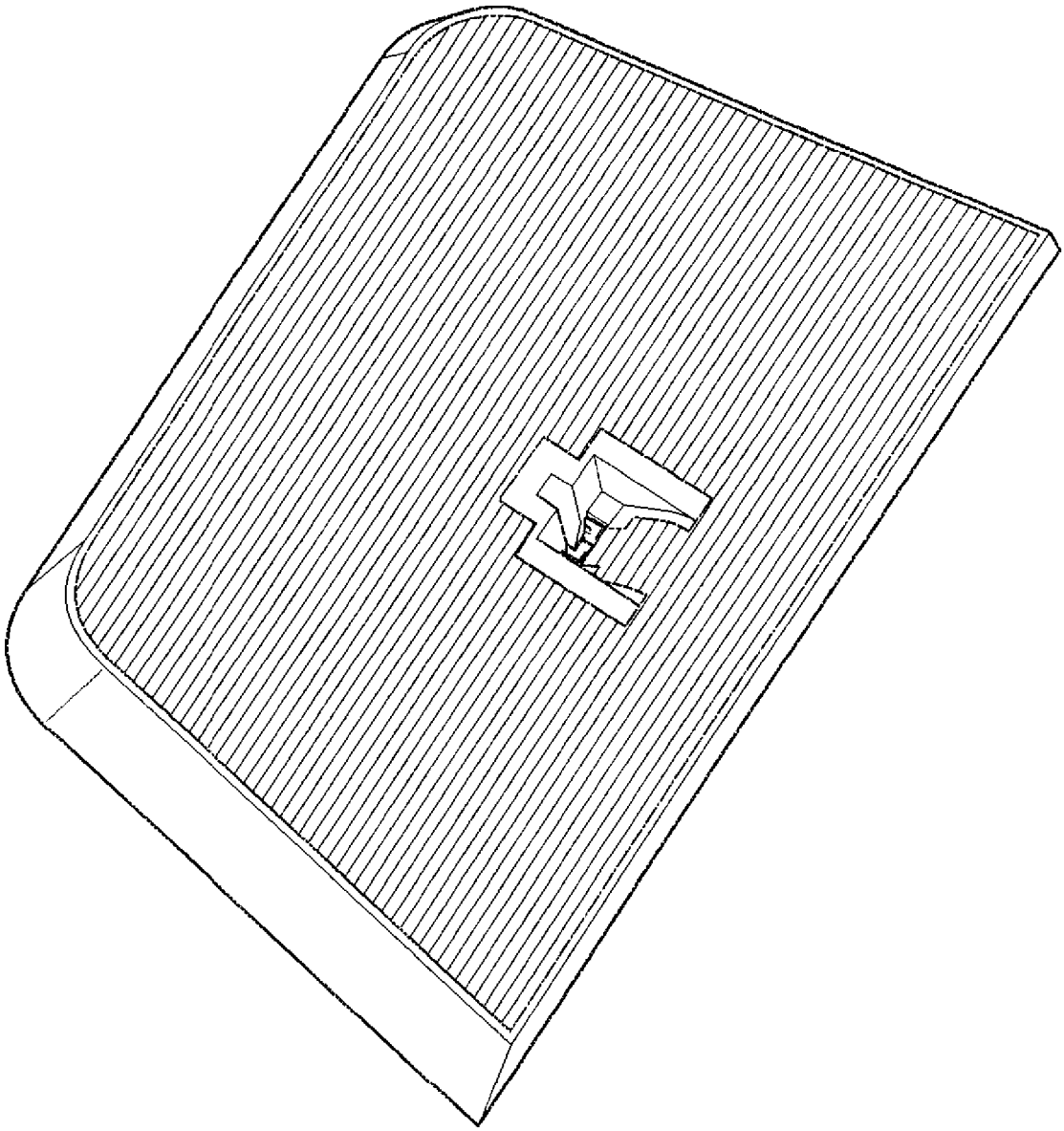
FIG. 5 is a perspective view of an antenna assembly where the feeding clip is positioned at the centre of the antenna assembly.

Finally, FIG. 5 is a perspective view of an antenna assembly according to one variant of the present invention. As is clearly disclosed in FIG. 5 the feeding clip may be positioned in a centre position on the support structure. Thus it is not required to position the feeding clip at the side of the support structure even if this may provide additional benefits in that the contact to the PCB may be achieved close to the periphery of the PCB. Occasionally though, the feeding clip may need to be provided at a centre position possibly for connecting further antennas.

It will be obvious that the invention may be varied in a plurality of ways. Such variations are not to be regarded as a departure from the scope of the invention. All such modifications as would be obvious to one skilled in the art are intended to be included within the scope of the appended claims.

The invention claimed is:

1. An antenna assembly comprising a support structure, a radiating structure and at least one feeding clip, said antenna assembly for mounting on a PCB in a mobile communication device, said support structure comprises a top side part to be oriented substantially parallel with said PCB and at least partly surrounding side parts supporting said top part so that said top part and said side parts form a box-like structure to be mounted on said PCB with said top side part away from the surface of said PCB, said radiating structure comprises at least one contact area, said contact area is provided on a surrounding side part by folding of said radiating structure over an edge of said top side part onto said surrounding side part, said feeding clip is mounted on one of said surrounding side parts and includes a first spring loaded portion exerting a contact force against said contact area for achieving electrical contact between said radiating structure and said feeding clip, said feeding clip includes a second spring loaded portion extending out and away from said surrounding side portion and exerting a contact force against a first contact area on said PCB for achieving electrical contact between circuitry located on said PCB and said feeding clip when said antenna assembly is mounted on said PCB, and said feeding clip includes a beam portion that is substantially U-shaped when viewed from the first and second spring loaded portions, the U-shaped beam portion located between the first spring loaded portion and the second spring loaded portion.

2. The antenna assembly according to claim 1, wherein said radiating structure is mounted at least partly on said top side part of said support structure.

3. The antenna assembly according to claim 1, wherein said radiating structure is mounted at least partly on a side part of said support structure.

4. The antenna assembly according to claim 1, wherein said surrounding side parts have a first defined height for distancing said radiating structure a defined distance from said PCB, and said feeding clip is a fraction in size of said first defined height so that said first spring loaded portion exert said force against said surrounding side portion a defined distance from said top side part.

5. The antenna assembly according to claim 1, wherein said U-shaped beam includes a first rectangular area, a second rectangular area, and a third rectangular area, the second rectangular area positioned along one longer side of said first rectangular area and orthogonal to the first rectangular area, the third rectangular area parallel with said second rectangular area and positioned along a second longer side of said first rectangular area opposite the first longer side where the first rectangular area is the bottom of the U-shaped beam, a first and second cut is provided in a first short side of said first rectangular area, the portion between said first and second cut is bent away from said second and third rectangular areas of said U-shaped beam to define said first spring loaded portion, said second spring loaded portion is extending from the middle of a second shorter side of said first rectangular area and is bent in an opposite direction of said first spring loaded portion.

6. The antenna assembly according to claim 5, wherein said second and third rectangular areas are provided with an upside-down L-formed cut extending from a free long side, and a portion of said second and third rectangular areas defined by said cut is bent out and away from said side to form a locking mechanism for locking said feeding clip in position in said support structure.

7. The antenna assembly according to claim 1, wherein said support structure comprises at least one receiving member for receiving said feeding clip in a press-fit coupling on said surrounding side part.

8. The antenna assembly according to claim 1, wherein a further feeding clip is provided for coupling said radiating structure to a grounding point on said PCB.

9. The antenna assembly according to claim 8, wherein said radiating structure comprises a further contact area, said further contact area is provided on a surrounding side part by folding of said radiating structure over an edge of said top side part onto said surrounding side part, said further feeding clip is mounted on one of said surrounding side parts and comprises a first spring loaded portion exerting a contact force against said further contact area for achieving electrical contact between said radiating structure and said further feeding clip, and said further feeding clip comprises a second spring loaded portion extending out and away from said surrounding side portion and exerting a contact force against said grounding point on said PCB for achieving electrical contact between said radiating structure and said feeding clip when said antenna assembly is mounted on said PCB.

10. The antenna assembly according to claim 8 or 9, wherein said feeding clip and said further feeding clip are mounted in close proximity to each other to thereby provide a minimal electrical pathway between said ground point and said first contact area.

11. The antenna assembly according to claim 1, wherein said feeding clip consists of a copper alloy or stainless steel.

12. The antenna assembly according to claim 1, wherein a spring loaded action for each of said first and second spring loaded portions is created by use of the elastic properties of the feeding clip material.

13. The antenna assembly according to claim 1, wherein said support structure is adapted to position said top side part a first distance from said PCB when the assembly is mounted on said PCB, and said feeding clip has a height that is smaller than said first distance between said top side part and said PCB.

14. The antenna assembly according to claim 1 wherein the second spring loaded portion is provided with a single contact area.

15. The antenna assembly according to claim 14 wherein the single contact area is configured to be brought into contact with the first contact area of the PCB when the second spring loaded portion is exerting the contact force and the antenna assembly is mounted on said PCB.

16. A feeding clip for mounting on a support structure to connect circuitry located in an electronic device to electrical circuitry located on said support structure, wherein:

said feeding clip comprises a first rectangular area, a second rectangular area orthogonally provided on one longer side of said first rectangular area, and a third rectangular area provided parallel and opposite with respect to said second rectangular area so that the first, second and third rectangular areas form a U-shaped beam where the first rectangular area is the bottom of the beam, a first short side of said first rectangular area includes a first and second cut, a portion between said first and second cut is bent away from said second and third rectangular areas of said U-shaped beam to define a first spring loaded portion, a second spring loaded portion extends from the middle of a second shorter side of said first rectangular area and is bent in the opposite direction of said first spring loaded portion.

17. The feeding clip according to claim 16, wherein said support structure is an antenna support structure, said electrical circuitry is a radiating structure, and said electronic device is a mobile communication device.

18. The feeding clip according to claim 16 wherein the second spring loaded portion is provided with a single contact area for making electrical contact with a contact area of the circuitry located in the electronic device or the electrical circuitry on the support structure.

19. An antenna assembly comprising a support structure for carrying a radiating structure and at least one feeding clip, said antenna assembly is provided to be mounted on a PCB in a mobile communication device, said support structure comprises a top side part which is to be mounted substantially parallel with said PCB, said top side part is positioned, when mounted on said PCB, at a first distance from said PCB, said radiating structure comprises at least one contact area located on said support structure, said feeding clip includes a U-shaped beam portion between a first spring loaded portion for coupling with said contact area and a second spring loaded portion for coupling with the PCB, and said contact area for said radiating structure is located at a position on said support structure where a distance between said contact area and the PCB is less than said first distance between said top side part and said PCB.

20. The antenna assembly according to claim 19 wherein the second spring loaded portion is provided with a single contact area for making electrical contact with a contact area of the PCB.

* * * * *